US009859667B2

(12) United States Patent
Zhang et al.

(10) Patent No.: US 9,859,667 B2
(45) Date of Patent: Jan. 2, 2018

(54) CABLE CONNECTOR ASSEMBLY HAVING AN ILLUMINATION FUNCTION

(71) Applicant: FOXCONN INTERCONNECT TECHNOLOGY LIMITED, Grand Cayman (KY)

(72) Inventors: De-Gang Zhang, Kunshan (CN); Chi-Ming Chen, New Taipei (TW); Zhi-Yang Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/272,342

(22) Filed: Sep. 21, 2016

(65) Prior Publication Data

US 2017/0085041 A1 Mar. 23, 2017

(30) Foreign Application Priority Data

Sep. 21, 2015 (CN) ..... 2015 2 0731106 U

(51) Int. Cl.

| | |
|---|---|
| ***H01R 3/00*** | (2006.01) |
| ***H01R 13/717*** | (2006.01) |
| *H01R 13/6592* | (2011.01) |
| *H01R 13/66* | (2006.01) |
| *H01R 31/06* | (2006.01) |

(52) U.S. Cl.

CPC ..... *H01R 13/7175* (2013.01); *H01R 13/6592* (2013.01); *H01R 13/6683* (2013.01); *H01R 31/065* (2013.01)

(58) Field of Classification Search

CPC ..... H01R 13/717; H01R 13/7175

USPC ..... 439/490; 362/95, 114

See application file for complete search history.

(56) References Cited

U.S. PATENT DOCUMENTS

| | | | | |
|---|---|---|---|---|
| 7,004,595 | B1 * | 2/2006 | Stoddard | H01R 13/6641 362/114 |
| 7,744,231 | B2 | 6/2010 | Hutchinson et al. | |
| 7,976,336 | B2 * | 7/2011 | Yang | H01R 13/6658 439/490 |

(Continued)

FOREIGN PATENT DOCUMENTS

| | | |
|---|---|---|
| CN | 203277853 U | 11/2013 |
| CN | 203660206 U | 6/2014 |
| CN | 204088797 U | 1/2015 |

*Primary Examiner* — Neil Abrams

(74) *Attorney, Agent, or Firm* — Wei Te Chung; Ming Chieh Chang

(57) ABSTRACT

A cable connector assembly includes a cable and a connector electrically connected with the cable for further electrically connecting with a power source. The connector includes: a main body; a plurality of contacts retained to the main body; a light emitting element; a printed circuit board (15) for controlling the light emitting element to emit light; and an outer case enclosing the connector and defining an indication area; wherein the connector further includes a conducting member mounted on the printed circuit board (15), the conducting member is a spring plate made of metal material pressing upon the indication area of the outer case, a front end of the outer case defines a transparent portion made of transparent material, and upon pressing the indication area, capacitance is affected and the light emitting element is turned on to emit light through the transparent portion.

13 Claims, 7 Drawing Sheets

(56) References Cited

U.S. PATENT DOCUMENTS

| | | | | |
|---|---|---|---|---|
| 8,105,106 | B1 * | 1/2012 | Stoddard | H01R 13/717 362/95 |
| 8,641,445 | B2 * | 2/2014 | Su | H01R 13/6658 439/490 |
| 8,740,640 | B2 | 6/2014 | Hardy | |
| 8,827,513 | B2 * | 9/2014 | Chen | H01R 13/6683 362/382 |
| 8,998,439 | B1 * | 4/2015 | Siddiqui | H01R 13/717 362/109 |
| 9,022,605 | B2 * | 5/2015 | Bushnell | H01R 13/631 320/107 |
| 9,028,122 | B2 * | 5/2015 | Tuchrelo | H01R 13/7175 362/253 |
| 9,160,118 | B2 * | 10/2015 | Tuchrelo | H01R 13/7175 |
| 9,450,350 | B2 * | 9/2016 | Chen | H01R 13/717 |
| 9,461,417 | B2 * | 10/2016 | Zhang | H01R 13/7175 |
| 9,515,427 | B2 * | 12/2016 | Wu | H01R 13/7175 |
| 9,531,137 | B2 * | 12/2016 | Zhou | H01R 13/7172 |
| 9,570,864 | B1 * | 2/2017 | Moyer | H01R 13/7175 |
| 2013/0065444 | A1 | 3/2013 | Bushnell | |
| 2013/0265747 | A1 * | 10/2013 | Liu | F21L 4/005 362/157 |
| 2013/0308304 | A1 | 11/2013 | Tuchrelo et al. | |
| 2016/0149353 | A1 * | 5/2016 | Chen | H01R 13/6675 439/490 |
| 2017/0085041 | A1 * | 3/2017 | Zhang | H01R 13/7175 |

* cited by examiner

CABLE CONNECTOR ASSEMBLY HAVING AN ILLUMINATION FUNCTION

BACKGROUND OF THE INVENTION

1. Field of the Invention

The present invention relates to a cable connector assembly, and more particularly to a cable connector assembly having an illumination function.

2. Description of the Related Art

A cable connector assembly is usually used to charge a rechargeable battery of a mobile electronic device. Cable connector assemblies usually do not have an indicator to indicate the charging status of a charging apparatus. Therefore, users need to turn on the apparatus for viewing the charging status, which is inconvenient.

U.S. Patent Application Publication No. 2013/0065444, published on Mar. 14, 2013, discloses a charging connection device comprising: a device connector configured to be coupled to a rechargeable electronic device; a circuit board coupled to the connector and including charging circuitry and an associated light source thereon; a housing enclosing the circuit board and including a first end comprising a lens, the connector extending from the first end; a touch-type switch carried by the housing, coupled to the circuit board, and configured to activate the light source; and a power source connector coupled to the circuit board and associated with a second end of the housing. The touch-type switch, such as touch plates on opposite sides of the housing, may be a resistance touch switch which needs two electrodes to be in physical contact with something electrically conductive (for example, finger(s) of a user) to operate. A capacitance touch switch or a touch chip-type switch may also be used.

U.S. Pat. No. 8,740,640, issued on Jun. 3, 2014, discloses an electrical connector including a light emitting diode (LED) and an electrical circuitry, e.g., implemented by a variable capacitance switch, to automatically energize the LED by a user's mere touching of an overmold thereof at its flat or bottom side without otherwise manually operating a control switch. A constant voltage is derived from power source and is applied across a variable and touch-sensitive capacitor and resistors to ground. In operation, before a user touches the flat or bottom portion of the overmold, capacitance is at a quiescent or fixed or default capacitance value; however, when a user touches the bottom or flat side of the overmold, the capacitor suddenly changes its capacitance value, and this causes the LED to be energized and emit light.

Therefore, a cable connector assembly having an improved illumination function is desired.

BRIEF SUMMARY OF THE INVENTION

An object of the present invention is to provide a cable connector assembly with an illumination function.

In order to achieve above-mentioned object, a cable connector assembly comprises: a cable; and a connector electrically connected with the cable for further electrically connecting with a power source, the connector including: a main body; a plurality of contacts retained to the main body; a light emitting element; a first printed circuit board for controlling the light emitting element to emit light; and an outer case enclosing the connector and defining a conductive area; wherein the connector further includes a conducting member mounted on the first printed circuit board, the conducting member is a shrapnel made of metal material pressing upon the conductive area of the outer case, a front end of the outer case defines a transparent portion made of transparent material, and upon pressing the conductive area the light emitting element is turned on to emit light through the transparent portion.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
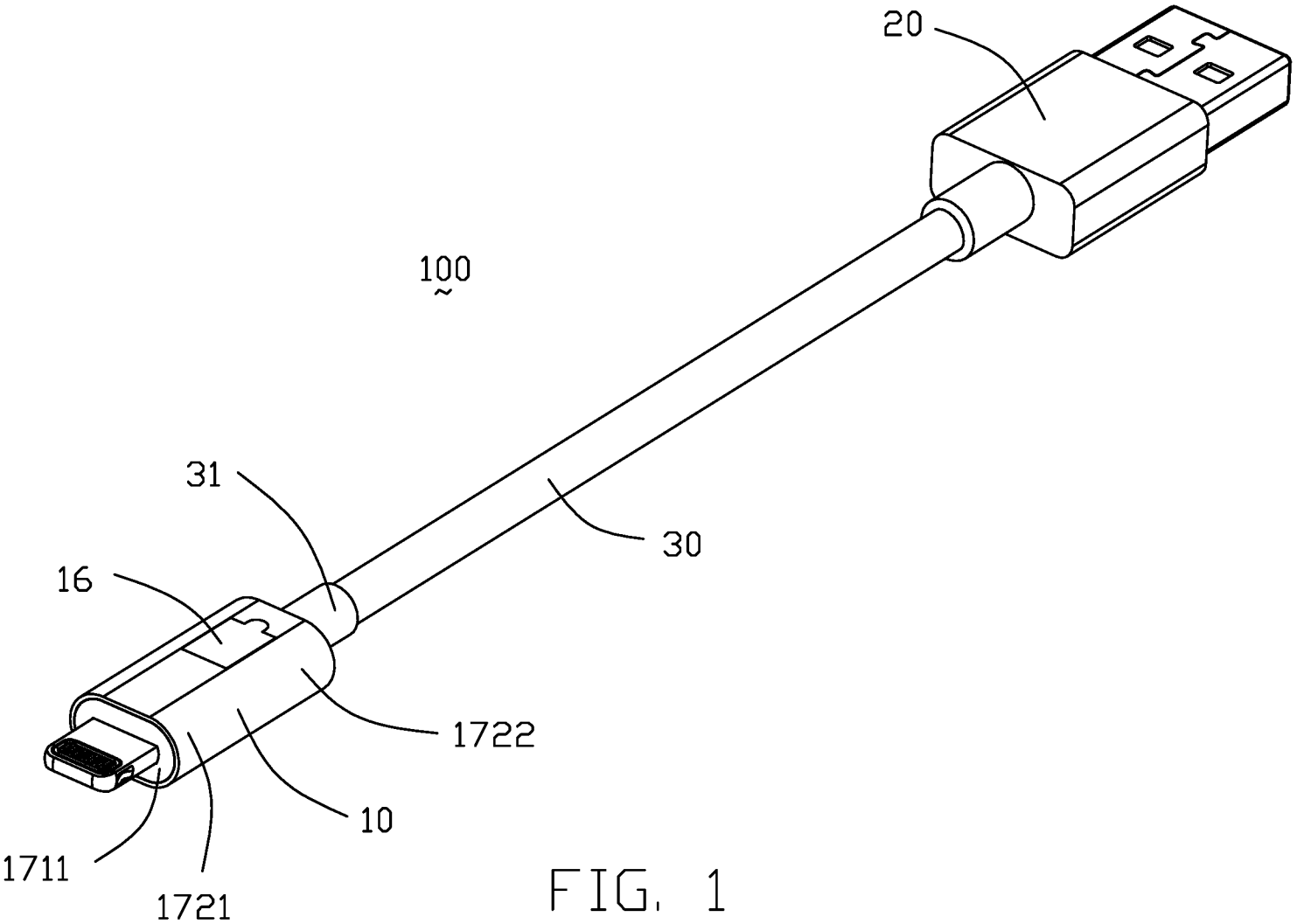
FIG. 1 is a perspective view showing a cable connector assembly in accordance with the present invention.

Reference will now be made to the drawing figures to describe a preferred embodiment of the present invention in detail. Referring to FIGS. 1-12, the cable connector assembly 100 according to the present invention includes a first connector 10, a second connector 20, and a cable 30 electrically connected between the first connector 10 and the second connector 20.

Referring to FIGS. 2-7, the first connector 10 includes a main body 11, two rows of contacts 12 retained in the main body 11 and respectively exposing to the opposites sides of a front end of the main body 11, a first printed circuit board 13 assembled on a rear end of the main body 11, a metal shell 14 enclosing the main body 11 and the first printed circuit board 13, a second printed circuit board 15 electrically connected to the first circuit board 13 and the cable 30, an indicating member 16, and an outer case 17 enclosing the metal case 14, the second circuit board 15, and a conjunction portion of the cable 30 and the second circuit board 15. The first printed circuit board 13 and the second printed circuit board 15 commonly form the printed circuit board assembly.

Referring to FIGS. 4-7, the metal case 14 includes a symmetrical first case 141 and a second case 142 engaged with the first case 141 along a left-to-right direction. The first case 141 includes a pair of holding plates 1411 opposite to each other along a up-to-down direction, a connecting portion 1412 connecting between the outer sides of the holding plates 1411, a sheet-shaped positioning portion 1413 rearwardly extending from a rear end of the connecting portion 1412, and an inclined fixing portion 1414 extending inwardly from a rear end of the positioning portion 1413. The second case 142 includes a pair of holding plates 1421, a connecting portion 1422 connecting between the outer sides of the holding plates 1421, a sheet-shaped positioning portion 1423 rearwardly extending from a rear end of the connecting portion 1422, and an inclined fixing portion 1424 extending inwardly from a rear end of the positioning portion 1423. A tail end of the fixing portion 1414, 1424 is of fork-shaped. The holding plates 1411 of the first case 141, the holding plates 1421 of the second case 142 and the connecting portions 1412, 1422 form a receiving room 140 jointly for receiving the main body 11 and the first printed circuit board 13. The positioning portion 1413 of the first case 141 is parallel and opposite to the positioning portion 1423 of the second case 142. The opposite sides of the second circuit board 15 are fixed on corresponding positioning portions 1413 and 1423 to fix the second circuit board 15 along the left-to-right direction.

The cable 30 includes a plurality of wires. An end of the cable 30 defines a strain relief 31 and a retaining portion 32 forwardly extending from a front end of the strain relief 31. The wires of the cable 30 are electrically connected with the first printed circuit board 13 and the second printed circuit board 15 though the retaining portion 32. The fixing portions 1414, 1424 engaged with each other to fixing the wires of the cable 30. The cable 30 includes a power signal wire electrically connected with the second printed circuit board 15. The first printed circuit board 13 defines a grounding signal wire electrically connected with the second printed circuit board 15. The power signal wire of the cable 30 provides power source for the second printed circuit board 15. The grounding signal wire of the first printed circuit board 13 provides a grounding loop for the second printed circuit board 15.

Figure 6:
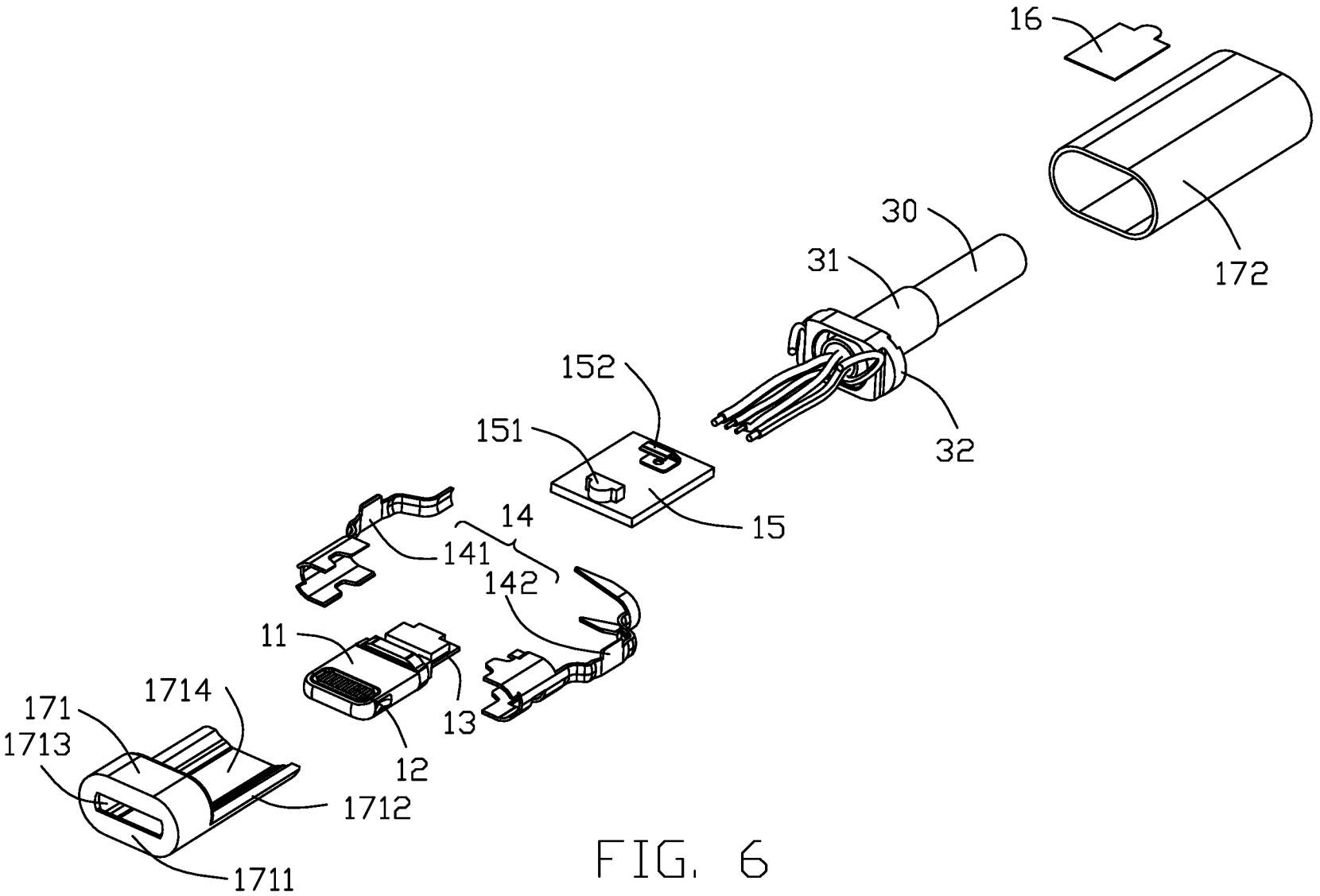
FIG. 6 is an exploded view showing the cable connector assembly shown in FIG. 2.
Figure 7:
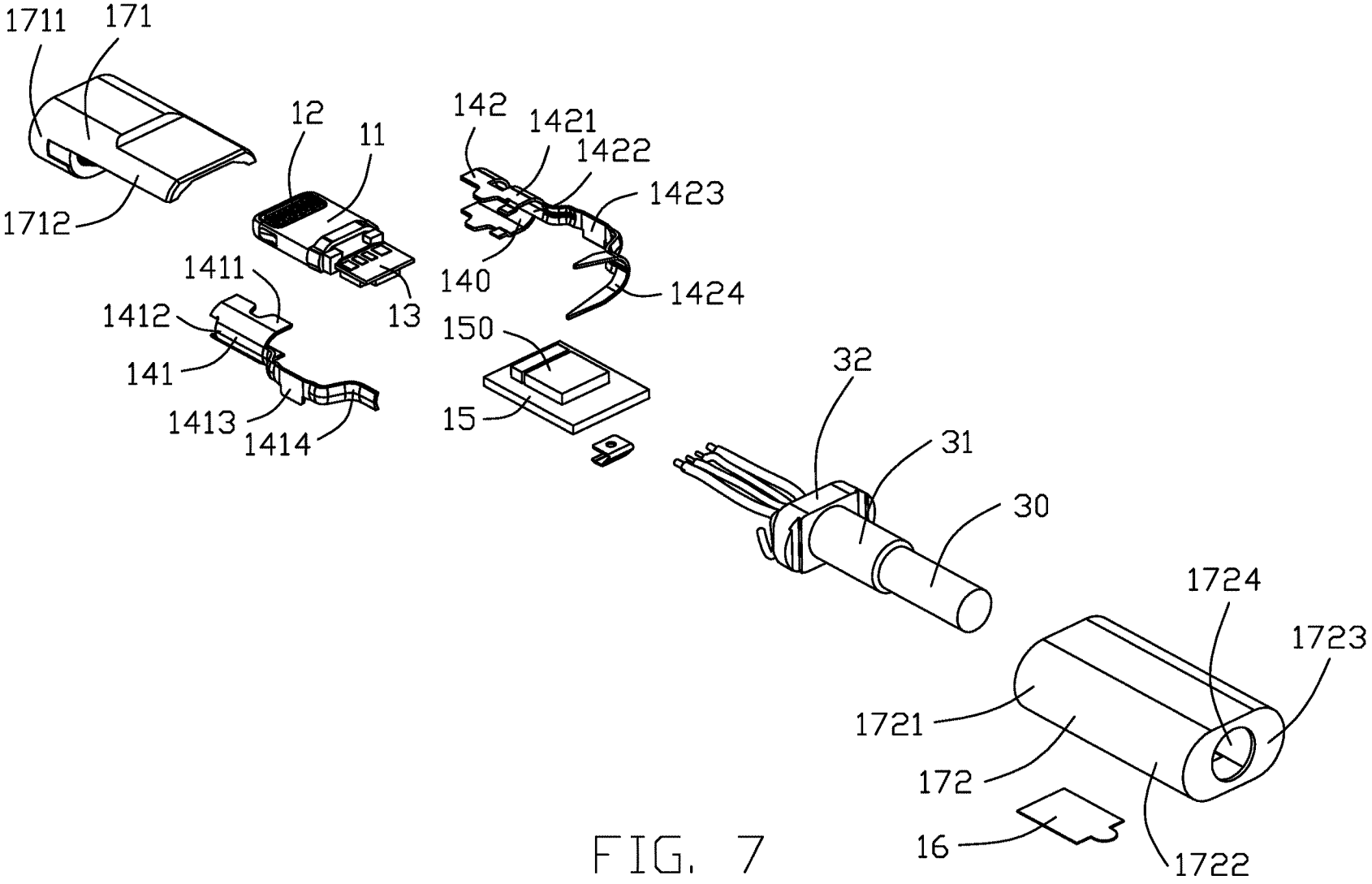
FIG. 7 is an exploded view similar to the FIG. 6 but from a different perspective.

Referring to FIGS. 6-7, the second printed circuit board 15 defines a controlling chip 150, a light emitting element 151 electrically connected with the controlling chip 150 and an elastic conducting member 152 which is deflectable in a vertical direction perpendicular to the printed circuit board 15. The conducting member 152 is a spring plate. The controlling chip 150 is defined on a side of the second printed circuit board 15 close to the first printed circuit board 13. The light emitting element 151 and the conducting member 152 are defined on a side of the second printed circuit board 15 away from the first printed circuit board 13. The controlling chip 150 controls the light emitting element 151 to light in a set form. The conducting member 152 includes a soldering portion 1521 soldered on the second circuit board 15, an inclined connecting plate 1522 upwardly extending from a side of the soldering portion 1521 and a pressing plate 1523 parallel to the soldering portion 1521 extending form a side of the connecting plate 1522.

Figure 2:
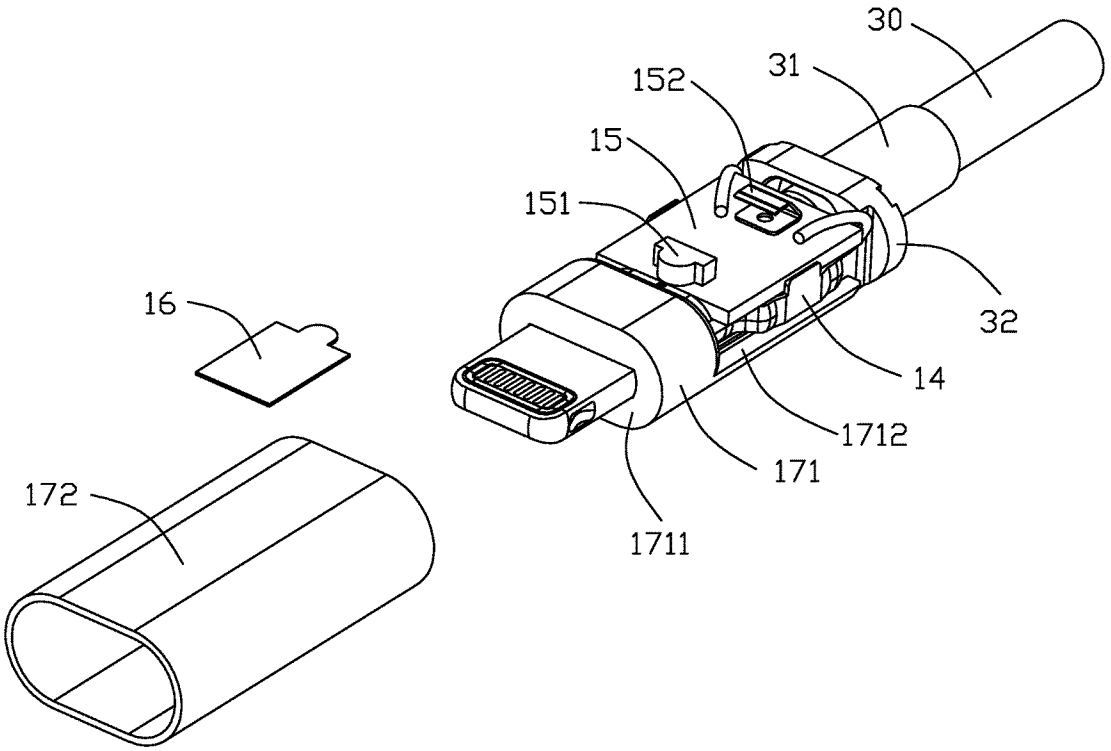
FIG. 2 is a perspective view of the cable connector assembly shown in FIG. 1, omitting a second connector thereof.
Figure 3:
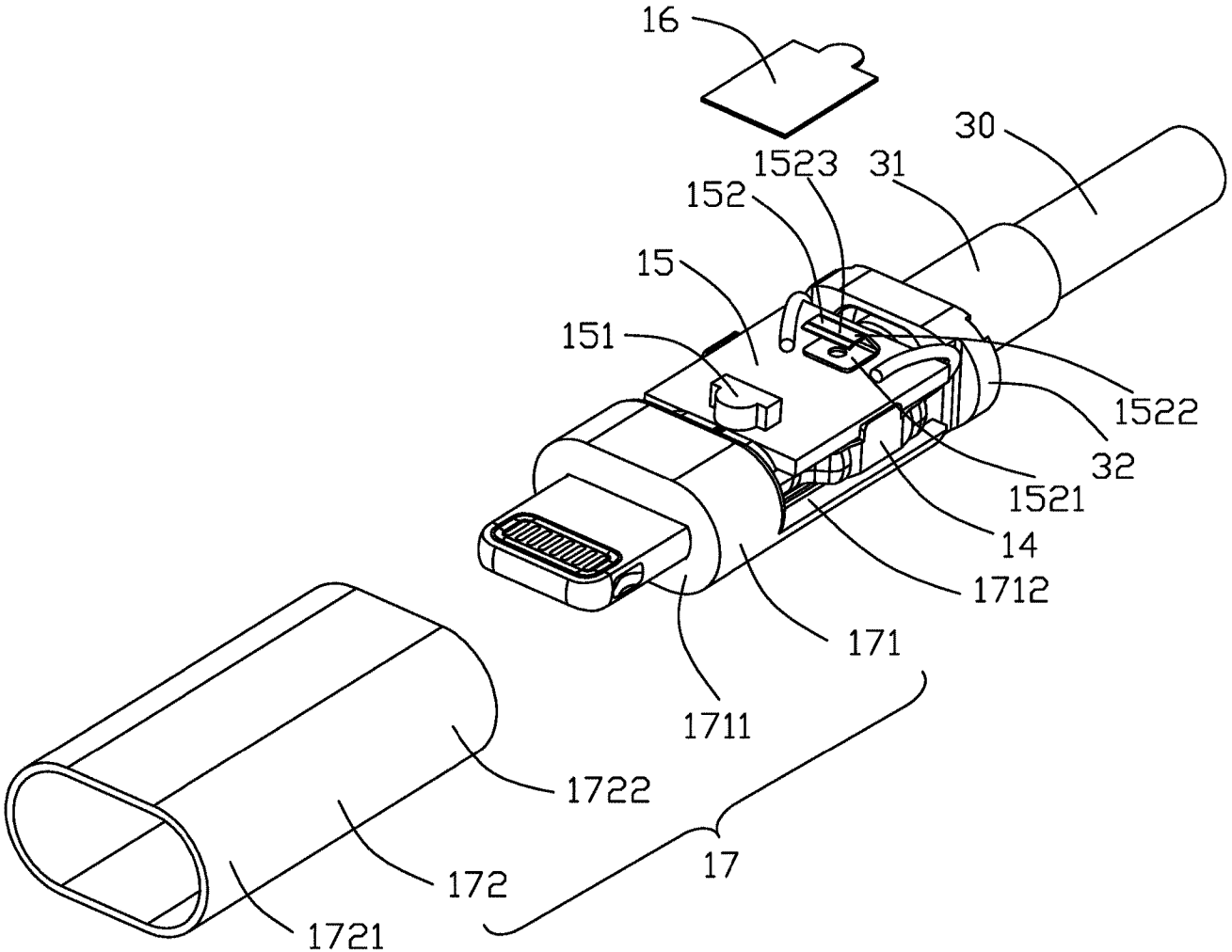
FIG. 3 is a further partially exploded view of the cable connector assembly shown in FIG. 2.
Figure 4:
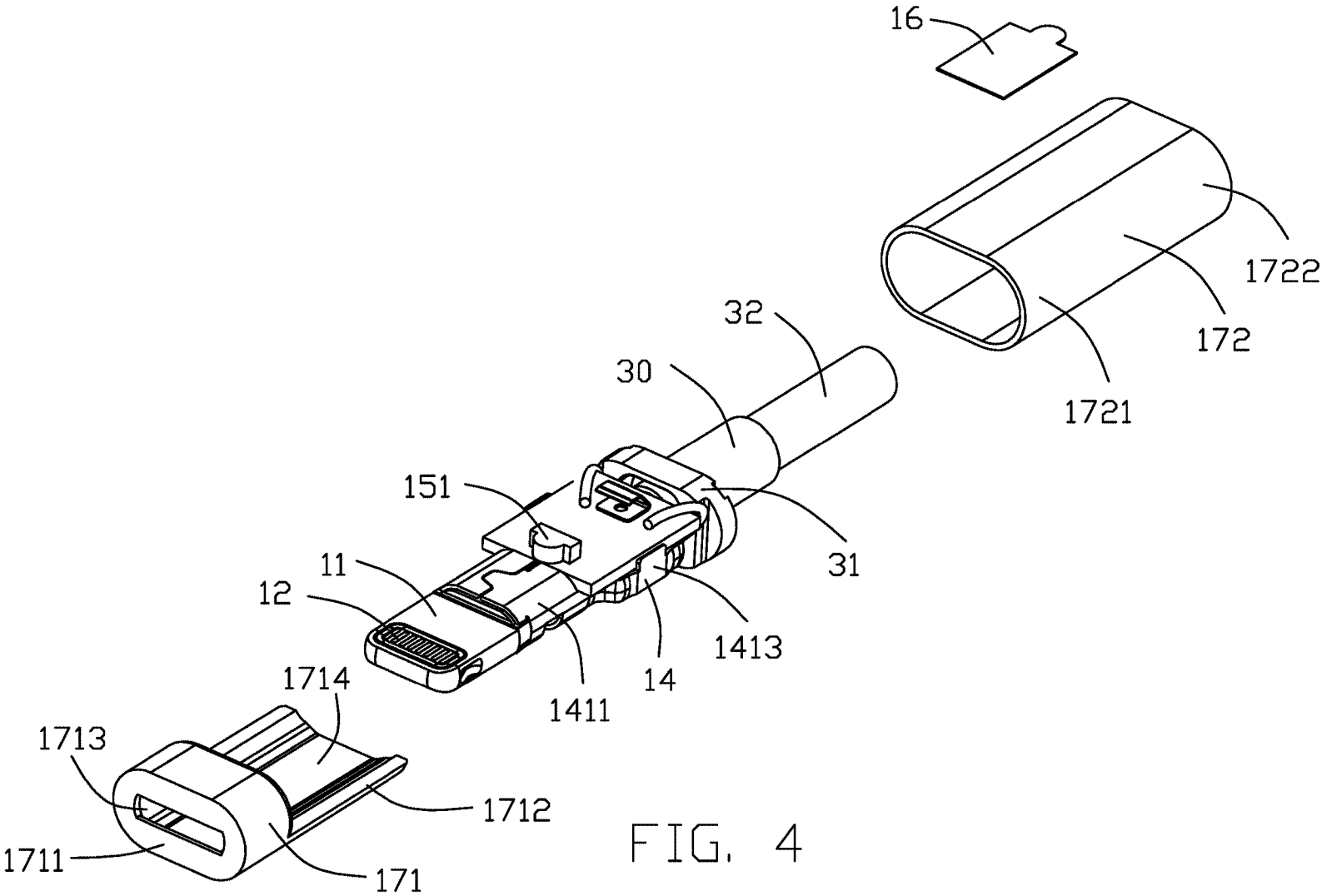
FIG. 4 is a further partially exploded view of the cable connector assembly shown in FIG. 3.
Figure 5:
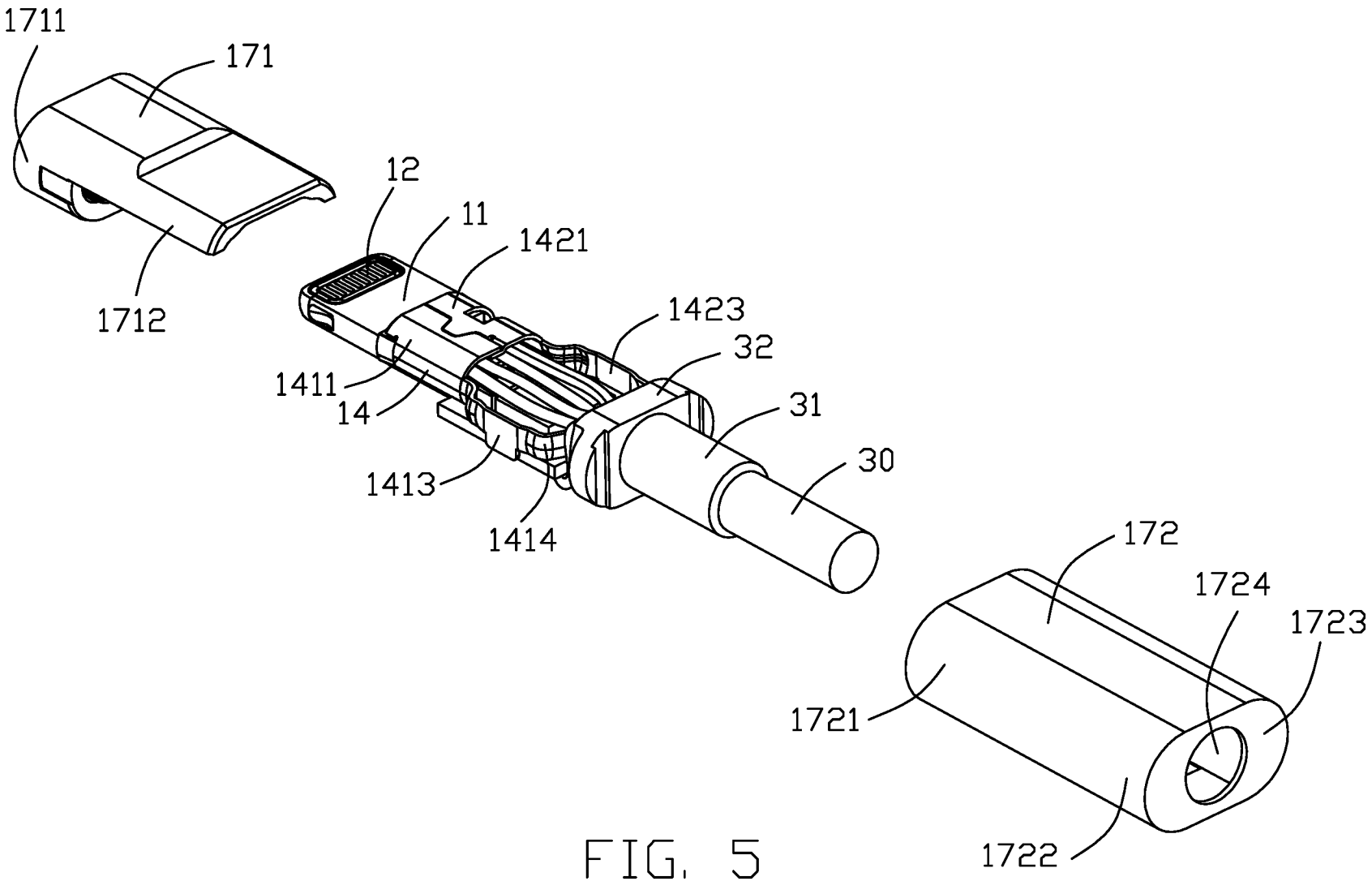
FIG. 5 is a partially exploded view similar to the FIG. 4 but from a different perspective.

Referring to FIGS. 2-7, the outer case 17 includes a first portion 171 and a second portion 172 enclosing the first portion 171. The first portion 171 includes a front end portion 1711, the cross section of which is of ellipse ring, and a sheet shaped receiving portion 1712 rearwardly extending from a bottom end of the front end portion 1711. The front end portion 1711 defines a through hole 1713 on a central portion thereof. The receiving portion 1712 defines a receiving slot 1714 recessing from a top surface thereof for fixing a front end of the metal case 14. The front end portion 1711 is made of translucent transparent material, to allow light forwardly passing therethrough and being transmitted to a front side thereof. In other embodiments, the front end portion 1711 may define a translucent portion, for example, a light pipe through a front and a rear side thereof, to allow light forwardly passing therethrough and being transmitted to a front side thereof. The second portion 172 is of hollow sleeve, including a first end 1721 and a second end 1722 opposite to the first end 1721. The second end 1722 includes a rear end surface 1723 and a perforation 1724 defined on the rear end surface 1723. Referring to FIGS. 1-3, the strain relief 31 of the cable 30 is inserted into an opening of the second end 1722, and a rear end surface of the retaining portion 32 of the cable 30 bears against an inside wall of the rear end surface 1723. The front end portion 1711 of the first portion 171 is enclosed by the first end 1721 of the second portion 172, a front end surface of the front end portion 1711 exposing to the opening of the first end 1721. The pressing plate 1523 of the conducting member 152 bears against an inside wall of the second portion 172 and the elastic deformation of the connecting plate 1522 provides depression force to the pressing plate 1523.

The indicating member 16 is pasted on a an indication area of the second portion 172, which corresponding to the position the conducting member 152 located on, to indicate the area user can press. When users press the indication area, the second printed circuit board 15 is conducted by the conducting member 152, thus the pressing operation from users can be indicated by the second printed circuit board 15, and the light emitting element 151 is controlled by the controlling chip 150. When users press once, the light emitting element 151 is turned on for a period of time by the controlling of the controlling chip 150.

The first connector 10 of the cable connector assembly 100 according to this invention defines a light emitting element 151 in the inside of the outer case 17. When users press the outer case 17, the conducting member 152 conducts to reflect a change in capacitance value of a capacitor in the controlling chip 150 through the conductive path of the second printed circuit board 15, enabling the controlling chip 150 to control the light emitting element 152. The light emitting element 151 is disposed on a top position of the first connector 10, thus the light emitted by the light emitting element 151 is passed through the front end portion 1711 of the first portion 171 to conveniently illuminate a front area of the first connector 10 in poor lighting environment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A cable connector assembly comprising:

a cable; and a connector electrically connected with the cable for further electrically connecting with a power source, the connector including:

a main body;

a plurality of contacts retained to the main body;

a light emitting element;

a first printed circuit board connected to the contacts;

a second printed circuit board electrically connected to the first printed circuit board and the cable and including a controlling chip for controlling the light emitting element to emit light; and an outer case enclosing the connector and defining an indication area; wherein the connector further includes a conducting member mounted on the first printed circuit board, the conducting member is a spring plate made of metal material pressing upon the indication area of the outer case, a front end of the outer case defines a transparent portion made of transparent material, and upon pressing the indication area the light emitting element is turned on by the controlling chip to emit light through the transparent portion.

2. The cable connector assembly as described in claim 1, wherein the second printed circuit board is parallel to the first printed circuit board.

3. The cable connector assembly as described in claim 1, wherein the cable includes a power signal wire electrically connected to the power source, and the second printed circuit board is electrically connected with the power signal wire.

4. The cable connector assembly as described in claim 1, wherein the first printed circuit board defines a grounding signal wire, and the second printed circuit board is electrically connected with the grounding signal wire.

5. The cable connector assembly as described in claim 1, wherein the conducting member and the light emitting element are disposed on a side of the second printed circuit board distal from the first printed circuit board.

6. The cable connector assembly as described in claim 1, wherein the connector comprises a metal case enclosing the main body and the second printed circuit board.

7. The cable connector assembly as described in claim 6, wherein the metal case includes a first case and a second case engaged to each other along a left-to-right direction to form a receiving room for receiving the main body and the second printed circuit board.

8. The cable connector assembly as described in claim 7, wherein each of a rear end of the first case and a rear end of the second case rearwardly extends to form a respective positioning portion, and the two positioning portions secure two opposite sides of the second printed circuit board.

9. A cable connector assembly comprising:

a connector including:

a main body including a mating tongue defining a front-to-back direction and a transverse direction perpendicular to each other;

a plurality of contacts retained to the main body;

a printed circuit board assembly, with a chip thereon, located behind the main body in the front-to-back direction to control a light emitting element mounted upon the printed circuit board assembly;

a cable electrically and mechanically connected to a rear portion of the printed circuit board assembly;

an outer case enclosing a rear portion of the main body and the printed circuit board assembly, said outer case including a transparent front end portion in said front-to-back direction; and an elastic conducting member mounted on the printed circuit board assembly and deflectable in a vertical direction perpendicular to both said front-to-back direction and said transverse direction; wherein the outer case further includes an indication area intimately aligned with the elastic conductive member in a tensioned manner, and an indicating member is pasted upon the indication area for operation by pressing the indicating member to activate the light emitting element.

10. The cable connector assembly as claimed in claim 9, wherein said printed circuit board assembly includes a first printed circuit board and a second printed circuit board electrically connected with each other, and the cable is connected to the first printed circuit board while the chip and the light emitting element are mounted upon the second printed circuit board.

11. The cable connector assembly as claimed in claim 10, wherein the first printed circuit board is essentially located at a mid-level of the outer case while the second printed circuit board is offset from the mid-level in the vertical direction.

12. The cable connector assembly as claimed in claim 10, wherein the second printed circuit board is longer than and rearwardly extends beyond the first printed circuit board in the front-to-back direction.

13. The cable connector assembly as claimed in claim 10, wherein the cable includes a plurality of wires connected to both the first printed circuit board and the second printed circuit board.

* * * * *